United States Patent [19]

Worth

[11] Patent Number: 4,669,801

[45] Date of Patent: Jun. 2, 1987

[54] CONNECTOR WITH CONTACTS ON 0.025 INCH CENTERS

[75] Inventor: Sidney V. Worth, Flourtown, Pa.

[73] Assignee: Continental-Wirt Electronics Corp., Southampton, Pa.

[21] Appl. No.: 800,154

[22] Filed: Nov. 20, 1985

[51] Int. Cl.[4] ..... H01R 4/24

[52] U.S. Cl. ..... 439/404; 439/460

[58] Field of Search ..... 339/97 R, 97 P, 98, 339/99 R

[56] References Cited

U.S. PATENT DOCUMENTS

| | | | |
|---|---|---|---|
| 4,145,103 | 3/1979 | Knowles | 339/99 R |
| 4,188,083 | 2/1980 | Knowles | 339/99 R |
| 4,296,989 | 10/1981 | Larson et al. | 339/99 R |

*Primary Examiner*—Joseph H. McGlynn

*Attorney, Agent, or Firm*—Ostrolenk, Faber, Gerb & Soffen

[57] ABSTRACT

An insulation displacement connector is described for making contact to the wires of a flat multiconductor insulation cable wherein the wires are spaced by 0.050 inch or less, and may be as low as 0.025 inch. An insulation housing contains two rows of identical contacts which are easily loaded into the openings of the housing. The contacts have cable insulating shearing tines extending beyond one surface of the housing and nose ends for receiving header pins or other mating members at the outer surface of the housing. The tines of the contacts in one row of openings are staggered from those of the adjacent row by the distance between wires in the connecting cable. A metal latch secures a cover to the insulator base and a special metal strain relief strap is fixed to the cover to hold the cable in position against strain forces which would tend to pull the cable away from its connection with the tines. The overall design is such that the socket and header can be disconnected from one another without destroying the assembly.

20 Claims, 21 Drawing Figures

FIG. 3.
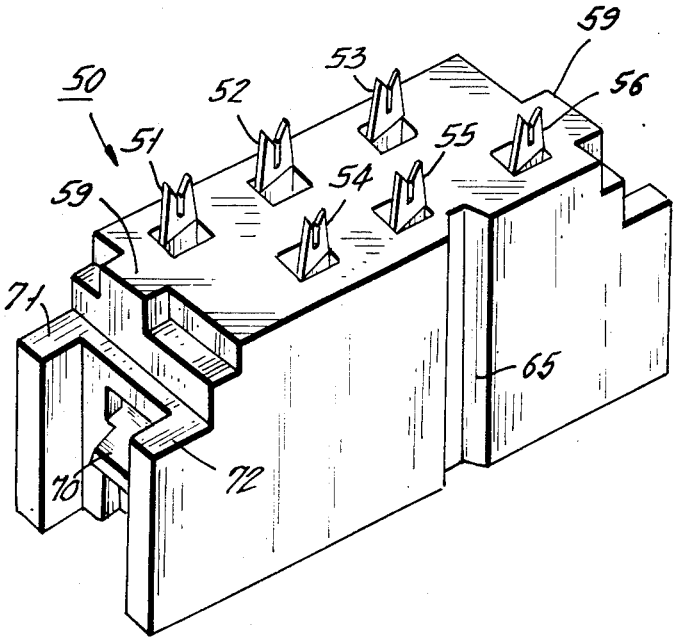
FIG. 4.
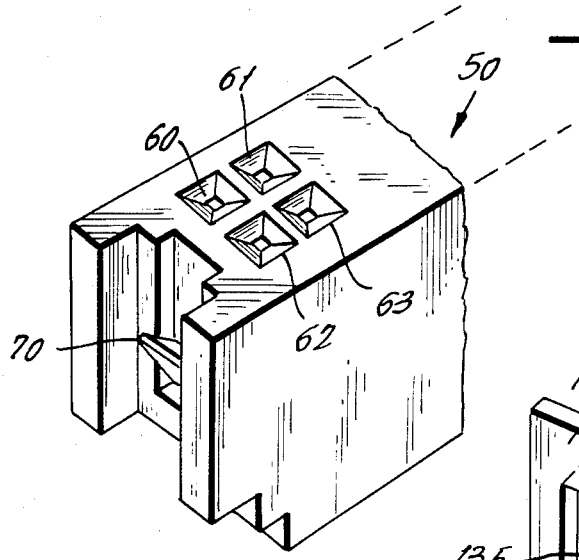
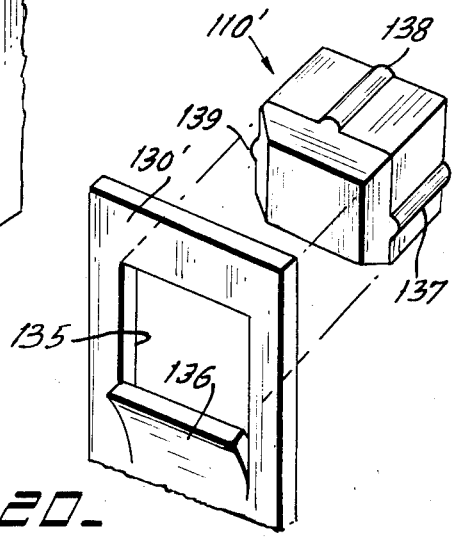
FIG. 20.

FIG. 7
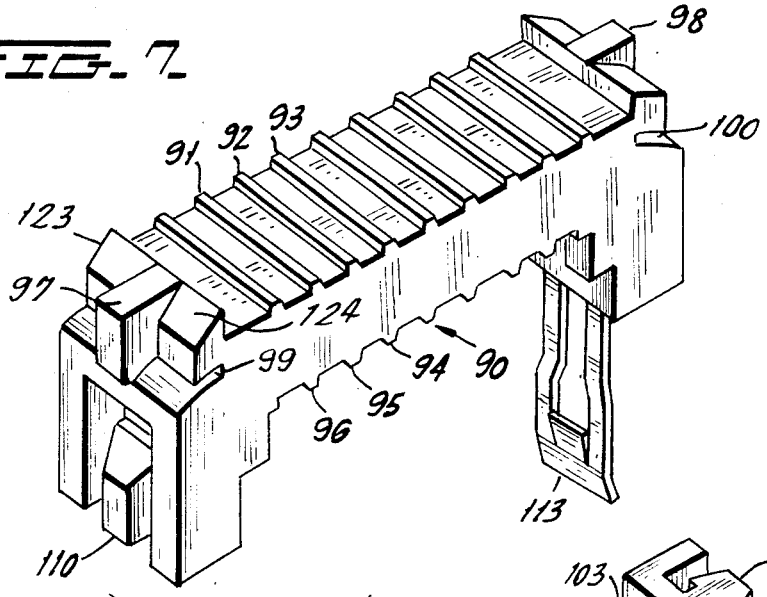
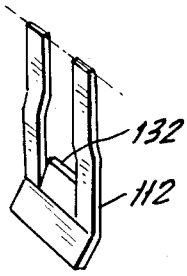
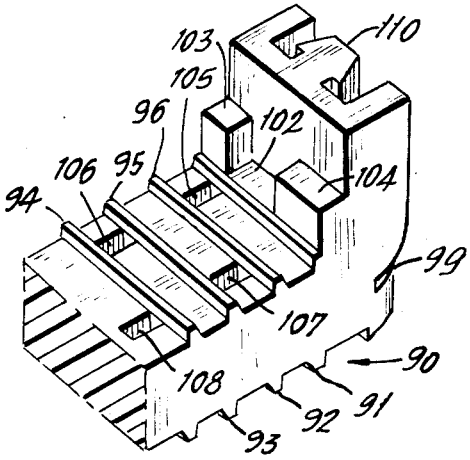
FIG. 8
FIG. 9
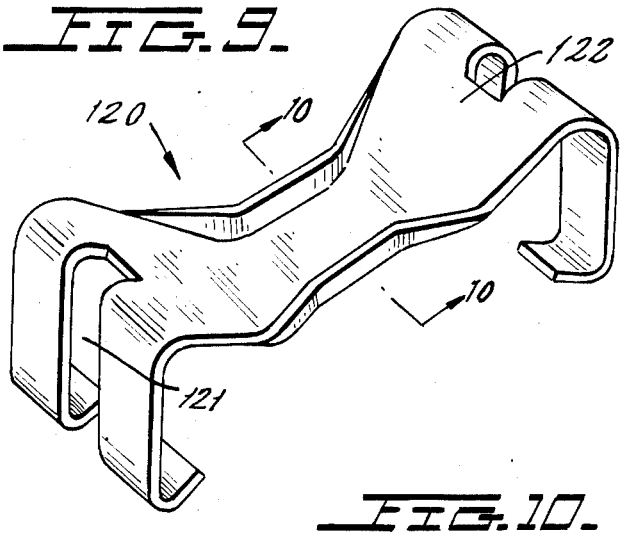
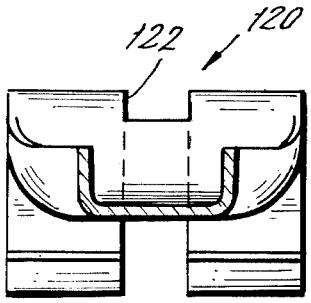
FIG. 10

CONNECTOR WITH CONTACTS ON 0.025 INCH CENTERS

BACKGROUND OF THE INVENTION

This invention relates to connectors for making connection to the plural wires contained in a flat multi-conductor cable, and more specifically relates to a novel connector structure which enables connection to wires spaced on centers as small as 0.025 inch.

Electrical connectors for making connection to the plural wires of a flat multiconductor cable are well known. Conventionally, such wires are spaced from one another on centers of about 0.05 inch. However, multiconductor cable is being made with the wires on even closer centers than 0.050 inch and indeed are now made with wires on 0.025 inch centers. Connectors for such multiconductor cable experience extremely high forces when the connector socket is connected and disconnected from the header because of the large number of high pressure contacts which must be separated and which must be very closely spaced, thus limiting the strength of the components.

The present invention provides a novel connector which enables connection to multiconductor cable having wires spaced by as low as 0.025 inch where the connectors can be easily assembled, using identical contact elements for each contact position and wherein the connector has the physical strength to enable disconnection of the connector and header without damage to the connector.

BRIEF DESCRIPTION OF THE INVENTION

In accordance with the present invention, a novel connector structure is provided which includes an insulation housing having two rows of contact receiving openings which receive identical contacts having a general rectangular configuration and formed from a flat stamping, having insulation cable piercing tines extending from one and contact noses extending from the other end. The contact tines are asymmetrically disposed. When loading into the rows of openings, the contacts are loaded in one row with the tine having a first angular position, whereas the tines of the second row are rotated by 180° from the position of the contacts in the first row. This rotation separates the center lines of the tines of the first and second rows by the desired spacing of 0.025 inch (or any other spacing required) in view of the asymmetric positioning of the tines of each contact.

A novel cover structure is provided for the housing and novel metal latches of high strength are employed to forceably secure the cover to the housing. A novel metal strain relief strap is also provided which is snapped atop the cover to press against the cable which overlies the top of the cover and prevents forces on the cable from being transmitted to the contacts which penetrate the cable.

The overall design of the connector and its associated header are such as to provide an extremely sturdy structure capable of withstanding disconnection forces which may be as high as 40 pounds for a connector arranged to make connection to 100 wires of a 100-wire flat multiconductor cable.

BRIEF DESCRIPTION OF THE DRAWINGS

FIG. 3 is a perspective view of the insulation base of the connector of the present invention showing only a few of the contacts in position wherein a commercial unit can have fifty or more contacts rather than the six shown in FIG. 3.

FIG. 4 is a perspective view as seen from the bottom of the base of FIG. 3.

FIG. 7 is a perspective view of the cover for the connector of FIGS. 1, 2, 3 and 4.

FIG. 8 is a perspective view of a portion of the bottom of the cover of FIG. 7.

FIG. 9 is a perspective view of the stress relief cover for the cover of FIGS. 7 and 8.

FIG. 10 is a cross-sectional view of the cover of FIG. 9 taken laterally through the center of the cover.

FIG. 20 is an exploded view in perspective of a latching arrangement that may be used in lieu of the latching arrangement of FIGS. 11–14.

DETAILED DESCRIPTION OF THE DRAWINGS

Figure 1:
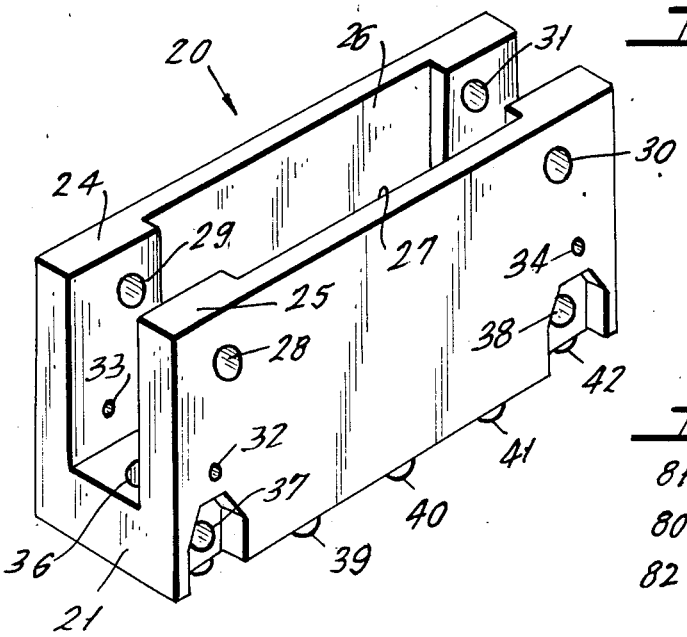
FIG. 1 is a perspective view of the header base used in conjunction with the present invention.
Figure 2:
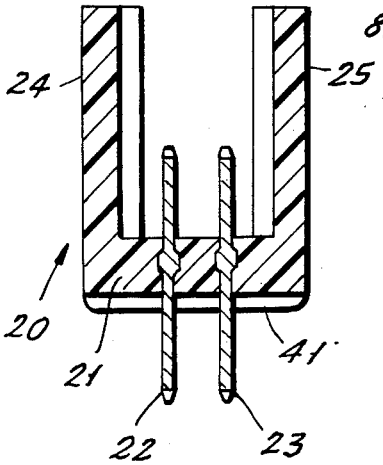
FIG. 2 is a cross-sectional view taken laterally across the center of the header base of FIG. 1.
Figure 14:
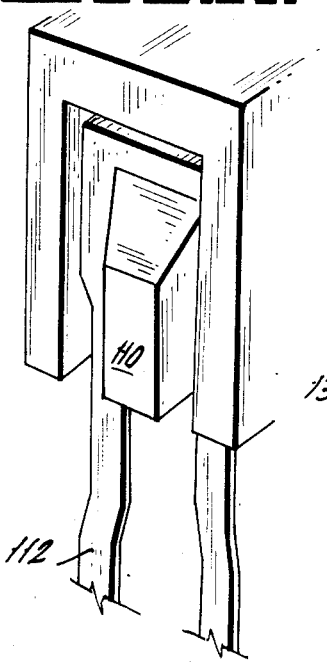
FIG. 14 is a perspective view illustrating the manner in which the latch of FIGS. 11, 12 and 13 is installed over the pyramid mounted on the cover of FIGS. 7 and 8.

The individual components which go into the novel connector are first described. The header 20 of FIGS. 1 and 2 is of molded insulation material and has a generally U-shaped cross-section. The walls may have keying knockout ribs (not shown) such as discussed in U.S. Pat. No. 4,348,073, assigned to the present assignee, if desired, or fixed ribs (such as designated 65 in FIG. 16). The base 21 of the header contains conduction header contact pins such as pins 22 and 23 shown in FIG. 2. These pins will be axially spaced from one another by about 0.05 inch and each contact may have a square cross-section of about 0.013 inch on a side. In a typical header base, 50 contacts, 25 in each of two rows, may be provided.

The upstanding walls 24 and 25 of the header have recessed sections 26 and 27 and have aligned openings 28-29 and 30-31 which receive dimples on plastic latches which will be later described. Also provided are aligned openings 32-33 and 34 and another not shown which are arranged to receive the pivot pins or roll pins of the header latches.

Two means of mounting the header are provided: the opening 36 extending laterally through the base 21 and openings 37 and 38 through the bottom of the header. Hex indentations can be used to prevent the turning of a nut if a nut is used in the mounting arrangement.

The bottom of the header also contains standoff bumps such as the bumps 39, 40, 41 and 42 which can have a height, for example, of 0.010 inch.

FIGS. 3 and 4 show the base structure employed with the present invention. The base structure 50 is a molded plastic body having a plurality of carefully dimensioned openings extending therethrough as will be later described in connection with FIG. 17. These openings receive identical contacts such as contacts 51–56 arranged in two different rows as shown in FIG. 3 for purposes of illustration. In an actual connector, 50 contacts might be provided in two rows of 25. One hundred contact connectors would have two rows of 50 contacts.

Each of the contacts 51–56 are identical in construction and have protruding tine ends capable of piercing the insulation of a multiconductor cable to engage respective wires of the cable as will be later described. The opposite ends of the openings recieving the contacts have entry openings, shown in FIG. 4 as the entry openings 60–63, also arranged in two rows for receiving the header pins of a header which will be later described. These header pins will be spaced from one another on centers of 0.050 inch. The body of the base may have one or more keyways 65 therein (FIG. 3) for receiving a polarizing key in the header of FIGS. 1 and 2 to ensure that the header and base are assembled to one another in only one of two possible orientations.

The opposite ends of the base provide a latch structure to enable the latching of a cover to the base as will be later described. In general, the end structure consists of a protruding integral insulation cam latch member 70 and projecting side walls 71 and 72 on opposite sides of the latch 70. As will be later seen, this cam latch 70 will receive a metal latch member. The opposite end of the base has a construction identical to that described for the end shown in FIGS. 3 and 4. The side walls 71 and 72 of the base tend to withstand any twist of the latches to be later described in response to side loading on the assembled cable which may be created by the user.

Figure 6A:
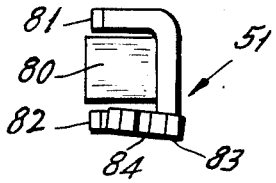
FIG. 6*a* is a top view of FIG. 5.
Figure 6:
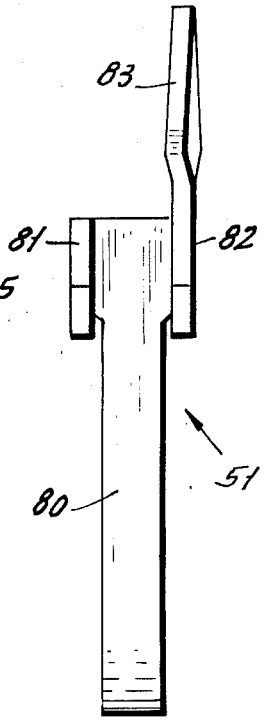
FIG. 6 is a side view of FIG. 5.
Figure 5:
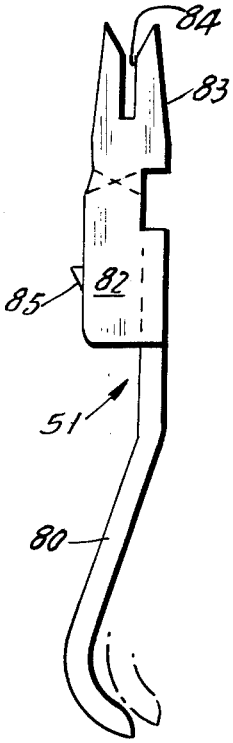
FIG. 5 is a front elevational view of one of the contacts which is secured within the base of FIGS. 3 and 4.

Next described is the contact itself as shown in FIGS. 5, 6 and 6*a*. The contact 51 which is described is of the cantilever nose type. Thus, the contact consists of a copper alloy stamping which may have a thickness, for example, of 0.010 inch and is suitably bent to the form shown. The contact has a nose end 80 which consists of a flexible relatively long member of curved shape to provide spring-type characteristics to enable it to engage a pin or a header pin with good contact pressure when the header pin is inserted into the base. Extending upwardly from the nose 80 are two orthogonally bent arms 81 and 82, although arm 81 may be deleted if desired. The arm 82 extends upwardly and carries the insulation cable piercing tine 83 which penetrates the insulation cable and receives a wire of the cable within its slot 84 to make good electrical contact to the wire. Note that the tine 83 is preferably twisted by about 5° from the plane of section 82 in accordance with the disclosure of U.S. Pat. No. 3,858,159 which is assigned to the assignee of the present invention.

The configuration of the contact 51 of FIGS. 5, 6 and 6*a* provides a generally U-shaped contact which can be more easily handled for assembly purposes than a single relatively flat contact and gives a relatively large capturing area within the base. Moreover, the nose 80 is prebent (FIG. 5) so that it will be forced against a wall in the opening of the base into which it is inserted and will therefore be preloaded within the base as will be later discussed. To assist in locking the contacts within the base, a barb such as the barb 85 (FIG. 5) can be provided in section 82.

Referring next to FIGS. 7 and 8, there is shown therein the novel cover for the connector. The cover 90 is of the floating type and is a molded plastic part having cable guides such as guides 91, 92 and 93 on its upper surface and guides 94, 95 and 96 on its bottom surface. The connector cover has identical ends which consist of guiding blocks 97 and 98 for guiding the metal strain relief member which will be later described and strain relief receiving slots 99 and 100. A slot 102 at each end of the cover 90 is adapted to alignedly receive a respective protrusion 59 of the body 50 (FIG. 3). Protrusions 102 and 104 at each end of the cover are used to align cable that is positioned against them. The cover is also provided with openings such as openings 105, 106, 107 and 108 disposed in the region which will receive tines which penetrate the insulation cable to which connection is made and to permit over-travel of the tines. Two long parallel slots can be used instead of discrete openings.

The sides of the cover also contain pyramids which are integrally molded with the cover and include the pyramid-shaped structure 110 shown in FIGS. 7 and 8. These pyramids are undercut at their bases to assist in the receipt of metal latches 112 and 113 which will be later described in more detail, and are used to latch the cover onto the base of FIGS. 3 and 4. Latches 112 and 113 are permanently attached to their cover pyramids and are arranged to spring over the cam latches 70 on the base 50 (FIG. 3) after the contact tines are connected to the cable.

There is next described the strain relief structure which is shown in FIGS. 9 and 10. The strain relief member 120 is of metal, preferably stainless steel, and provided with a general U-shaped cross-section for increased strength. Member 120 has slotted ends formed by the slots 121 and 122 which define respective pairs of legs. The free ends of the legs defined by slots 121 and 122 are slightly upwardly bent so that they can cam over sloping surfaces such as the sloping surfaces 123 and 124 of the cover of FIG. 7 so that the leg tips can snap into the slot 99. A similar configuration is provided for the other end of the cover and strain relief member 120. Note that the guide members 97 and 98 are received by the slots 121 and 122 during the assembly of the device. Thus, good restraint is provided against side pulls of the cable attached to the connector. The guides 97 and 98 also guide the strain relief member into place as it is assembled. The ends of the strain relief member terminate in the plastic body (slots 99 and 100) and no portions protrude unattached, resulting in greater strength of the connector.

The use of a metal for the strain relief member 120 ensures great strength even though the cover is small, particularly when the cover must be relatively long, as for an arrangement employing one hundred and fifty contacts (which would be about four inches long). The novel strain relief structure also has a relatively low profile. Of great importance, the strain relief member permits the easy use of a daisy chain type connection and allows for removal or replacement of the connectors at any time in a cable assembly since it can be easily removed without danger of breakage. This is in contrast to molded-in type strain relief plastic bars which become a permanent part of the cover and require a Z-type weaving of the cable into the connector.

Figure 11:
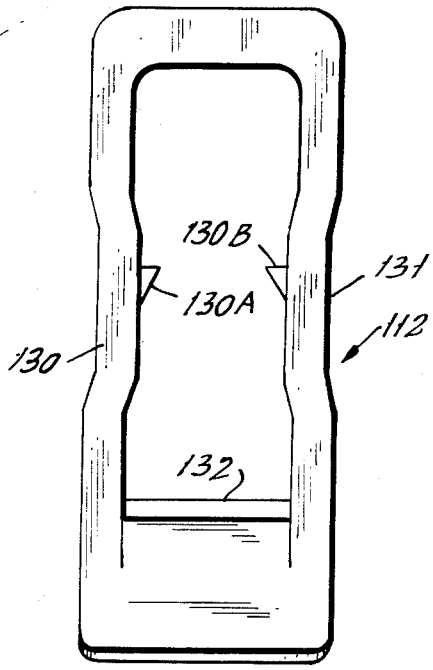
FIG. 11 is a front elevational view of the metal latch used for latching the cover of FIGS. 7 and 8 to the base of FIGS. 3 and 4.
Figure 12:
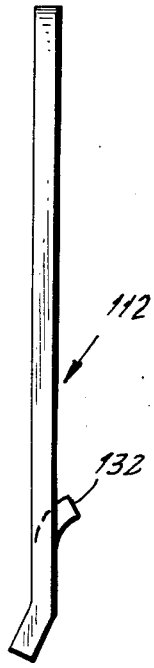
FIG. 12 is a side view of FIG. 11.
Figure 13:
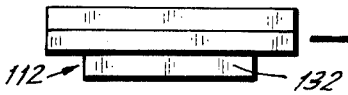
FIG. 13 is a bottom view of the latch of Fig. 11.

Next described in more detail in connection with FIGS. 11–14 is the novel metal latch 112 which was previously discussed in connection with FIG. 7. It is necessary to have an extremely high strength latch to lock the cover to the base since the 0.025 microconnector is intended to reduce overall dimensions drastically. Since a large number of contacts will be used, metal is used for the latch to obtain the necessary high strength. As shown in FIGS. 11, 12 and 13, the latch 112 has inwardly pressed side sections 130 and 131 which tend to snugly fit around the undercut section of the cover pyramid 110. It will also be noted that stops 130A and 130B can be provided in sections 130 and 131 in FIG. 11 to limit the maximum upward movement of the latch after its installation on the pyramids, such as pyramid 110. A metal lip 132 is stamped out of the plane of the latch as shown FIGS. 12 and 13. Lip 132 latches under the cam latch 70 (FIG. 3) on the ends of the base when the cover is moved into position. The latch 112 is installed permanently over the pyramid 110 by pressing it over the cover pyramid and into the indentations at the base of the pyramids. The sections 130 and 131 will spread sufficiently to snap over the pyramids and then snap into the indentations when they reach the indentations.

Figure 16:
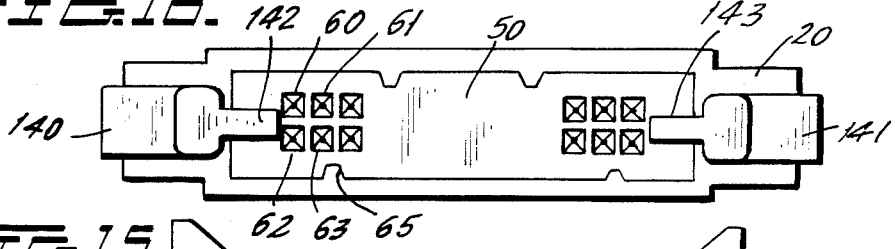
FIG. 16 is a bottom view of FIG. 15.
Figure 15:
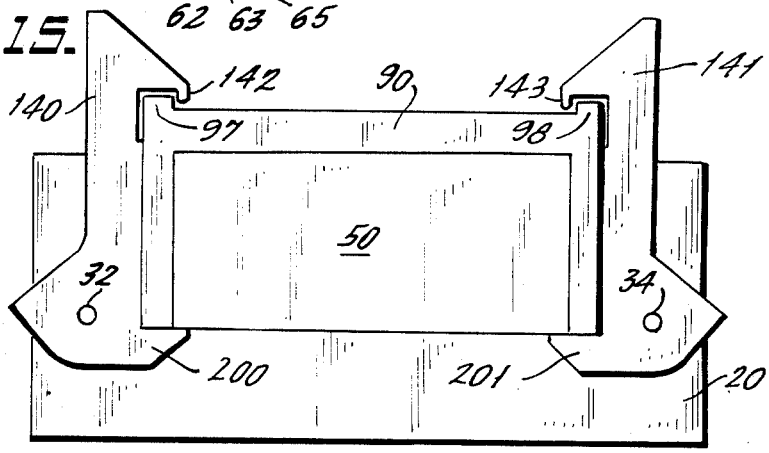
FIG. 15 is a side elevational view of an assembly of the cover of FIGS. 7 and 8 with the base of FIGS. 3 and 4 and with the mounting latches in position.
Figure 17:
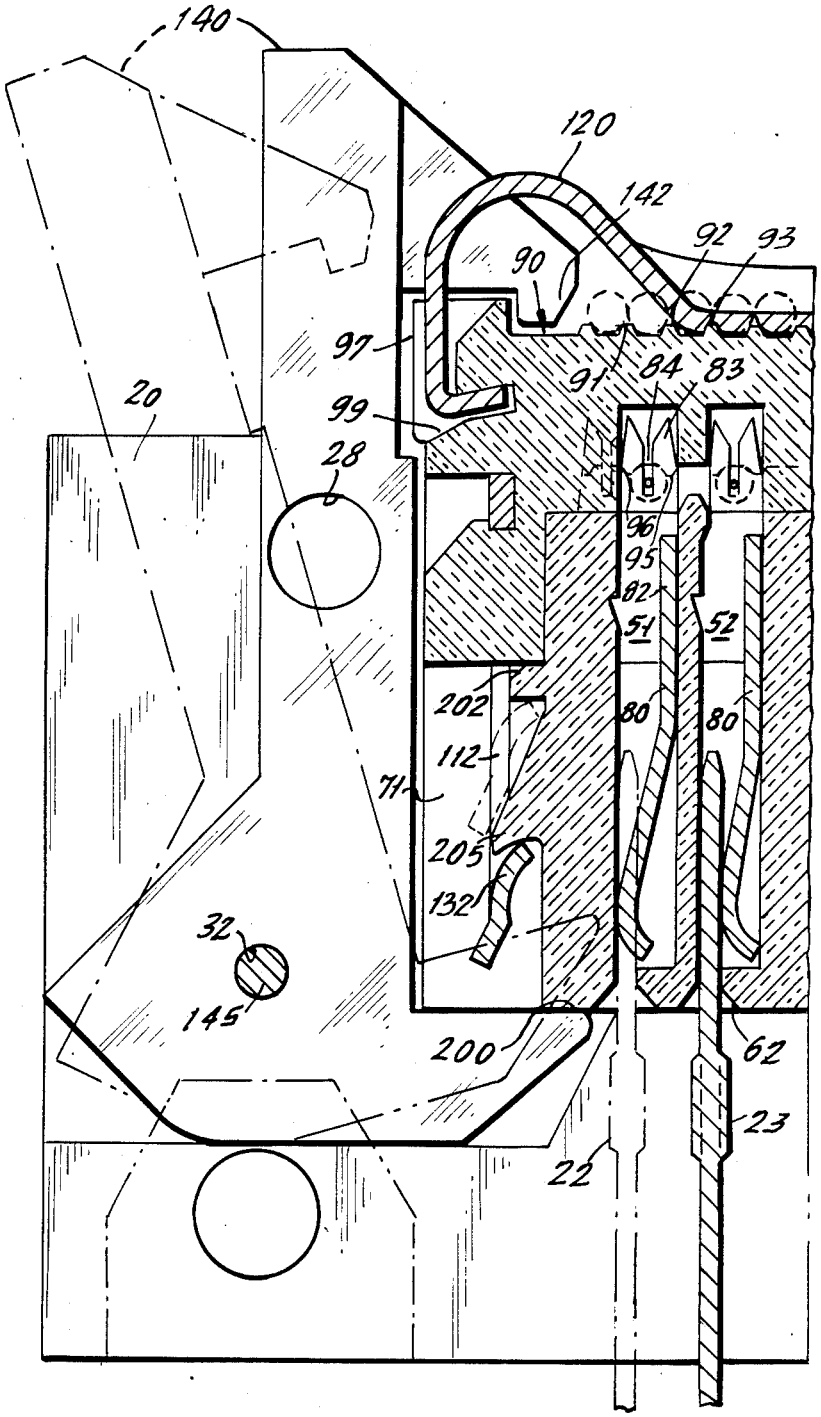
FIG. 17 is a cross-sectional view of an end portion of the assembly of FIG. 15.
Figure 18:
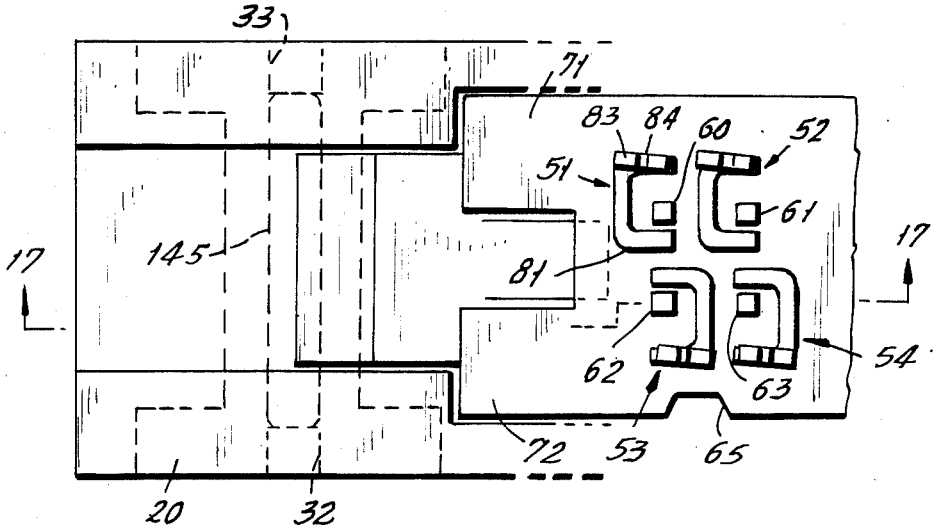
FIG. 18 is a top view of FIG. 17.

Assembly of the cover 90, base 50 and header 20 is carried out with the use of plastic latches such as latches 140 and 141 shown in FIGS. 15 and 16 in which, for clarity, the strain relief member 120 (FIG. 9) is not shown. Note that, in FIG. 16, the contact positions in the body 50 are shown to approximate scale for a twenty-six contact socket. The latches 140 and 141 are pivotally mounted in appropriate pivot pins and contain latching noses 142 and 143, respectively, which tend to hold the latches in their latched position. The pivot pin 145 is shown in FIGS. 17 and 18 for the pivotal support for latch 140. Plastic latch 140 locks the contact socket in place when tips 142 and 143 go over blocks 97 and 98, respectively, and novelly go through the slots 121 and 122, respectively, in strain relief member 120 (FIG. 9). By having tips 142 and 143 latch directly onto blocks 97 and 98, the resulting connector acheives a considerably high structural integrity and stability. The tips 200 and 201 on the bottoms of the latches 140 and 141, respectively, eject the socket when the latches 140 and 141 are rotated outwardly.

Figure 19:
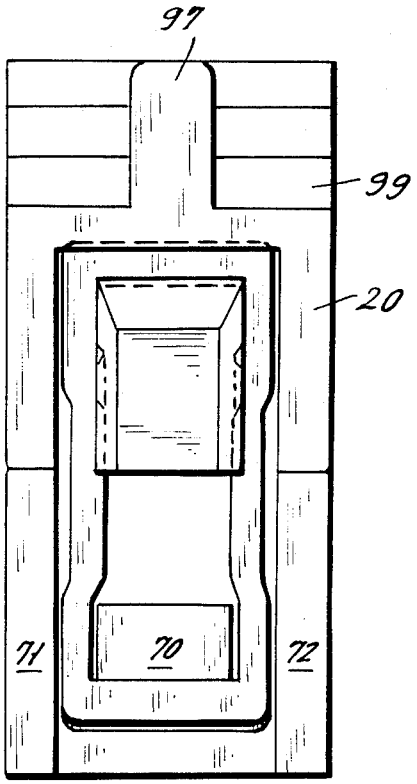
FIG. 19 is an end view of FIG. 17.

The assembly of the components described heretofore is best shown in FIG. 17. The assembly of FIGS. 18 and 19 is shown without the cover or strain relief member in place. As shown in FIG. 18, the contacts of the upper row of contacts, including contacts 60 and 61, have a first orientation whereas the contacts of the second row, including contacts 62 and 63, are rotated 180° relative to the contacts 60 and 61. This novel rotation, along with the design of the position of the slots in the tines ensure that the slots of the contacts of the two rows are displaced from one another by the desired dimension, for example 0.025 inch, even though the openings at the bottom of the base 50 are standard openings on 0.050 inch centers. The assembly of FIGS. 17, 18 and 19 is intended to permit connection to conductors of 32 gauge stranded and/or 30 or 34 gauge solid conductors in a multiconductor cable. Typically, the cable may have wires on centers of 0.025 inch and would be about 0.025 inches thick. A 50 conductor cable would be 1.125 inches wide, while a 100 conductor cable is 2.25 inches wide.

The cable is schematically illustrated in Fig. 17 by the circles which receive the tine ends of the contact such as contacts 51 and 52. A further run of cable above the cover is similarly schematically illustrated. Note that FIG. 17 shows the strain relief member in the position it assumes in the absence of a cable between the cover and the strain relief member 120.

FIG. 17 shows the header pin 23 as entering opening 62 in the bottom of the base 50 and pressing the nose end 80 of the contact 52 toward the right to create a subtantial contact pressure between the header pin 23 and the contact 52. When no header pin is in position, as shown for the contact 51 in FIG. 17, the nose end 80 presses against the left-hand side of the opening in the body 50 which receives the contact 51. Note that this preloads the contact within the body, thus assisting in the assembly of the contact 51 within the connector body. Moreover, the contact nose 80 of FIG. 17 is relatively long to enable tracking and automatic feeding during assembly.

The tine twist described previously for the twist of tines such as tine 81 to 5° is moderate but not enough to alter the desired tine shape. It does, however, alter or reduce the effective tail slot width and twists the entering conductor. By increasing the twist, one can further reduce the tine slot opening to permit connection to even finer conductors than those described above.

Initially, cover 90 is a "floating" part of the base with the latch tongue 132 held in the upper position shown in dotted lines in FIG. 17. Note that lip 132, in the upper, dotted line position, rests against projection 202. The cable is then placed between the cover 90 and the tops of the tines and cover 90 is depressed or pushed into its lower position until lip 132 of latches 112 and 113 lock over respective plastic cam 205. All tines simultaneously penetrate the cable and engage respective conductors in the cable. The latches 112 and 113 can be spread or pried away easily by a screwdriver tip, or the like, until lip 132 clears the cam 201. The cover 90 can then be removed, as well as the cable, for reuse of the connector.

As stated previously, the latches 140 and 141 have projecting dimples which seat in openings 28-29 and 30-31. These dimples are preferably sloped so that they increase in height from right to left in FIG. 17. This produces a cam-effect to allow latches 140 and 141 to move easily to the latched position of FIG. 17 but tends to prevent their easy movement to the unlatched position, shown in dotted lines in FIG. 17.

FIG. 20 shows a preferred latch structure that may be used in lieu of the latch structure described in connection with FIGS. 11–14. In FIG. 20, a modified pyramid 110' is adapted to extend through opening 135 in a modified latch 130'. Ribs 137, 138 and 139 extending toward the "top" of pyramid 110' are tightly engaged by latch 130' to help assure a stable mounting arrangement. The latch 130' includes a tongue 136 at the lower periphery of the latch opening 135 that is bent away from the pyramid 110'. Tongue 135 wedges itself against the lower side of the pyramid 110' when the latch is mounted on the pyramid to improve the structural integrity of the latch arrangement.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A connector for connection to the wires of a flat multiconductor cable; said connector comprising an insulation base, a cover member, and first and second metal latch members; said insulation base having a plurality of contacts fixed therein and disposed in at least one row; each of said contacts having insulation piercing tines extending above a first surface of said base, each of said contacts having a nose end connectable to respective header pins which extend into a second surface of said base; said base having first and second end surfaces, and first and second raised latch receiving members extending outwardly from said first and second end surfaces; said cover member comprising a generally flat insulation member having first and second metal latch members fixed to its opposite ends and extending perpendicularly from the length of said cover member, said cover member covering said first surface of said base after a multiconductor cable is connected to said tines of said contacts, said first and second latch members being engageable with said first and second raised latch receiving members respectively; said first and second metal latch members being capable of easy removal from said first and second raised latch receiving members and replacement without breakage; each of said contacts having an elongated flexible nose section which is biased against the wall of the opening which receives said contact, and wherein each of said contacts has first and second side members extending perpendicularly from the top of said nose section; said first extending member of each of said contacts being a relatively short height, said tine of each of said contacts being integrally formed with said second side member.

2. The connector of claim 1, wherein adjacent tines of said contacts are spaced by 0.025 inch.

3. The connector of claim 1 which further includes a metal strain relief member having a length at least equal to the length of said cover member; said metal strain relief member having bifurcated ends which are inwardly bent; said cover member having first and second slots at its said first and second end surfaces for receiving said inwardly bent bifurcated ends of said strain relief member; said strain relief member being capable of easy removal and replacement without breakage.

4. The connector of claim 1, wherein said tines of said contacts in said one row are oriented 180° with respect to said tines of said contacts in said other row.

5. The connector of claim 1, wherein said first and second metal latch members are flexible rectangular frame members; said cover member having integral latch members having pyramidal shaped surfaces and indented bases extending from the respective ends of said cover member; said flexible rectangular frame member being captured in said indented bases.

6. The connector of claim 5 which further includes a metal strain relief member having a length at least equal to the length of said cover member; said metal strain relief member having bifurcated ends which are inwardly bent; said cover member having first and second slots at its said first and second end surfaces for receiving said inwardly bent bifurcated ends of said strain relief member; said strain relief member being capable of easy removal and replacement without breakage.

7. The connector of claim 6, wherein adjacent tines of said contacts are spaced by 0.025 inch.

8. The connector of claim 1, wherein said plurality of contacts fixed in said insulation base are disposed in two parallel rows, with said insulation piercing tines of said contacts in one of said rows being oriented asymmetrically to said insulation piercing tines of said contacts of the other of said rows.

9. The connector of claim 8, wherein said tines of said contacts in said one row are oriented 180° with respect to said tines of said contacts in said other row.

10. A connector for connection to the wires of a flat multiconductor cable; said connector comprising an insulation base, a cover member, and first and second metal latch members; said insulation base having a plurality of contacts fixed therein and disposed in at least one row; each of said contacts having insulation piercing tines extending above a first surface of said base, each of said contacts having a nose end connectable to respective header pins which extend into a second surface of said base; said base having first and second end surfaces, and first and second raised latch receiving members extending outwardly from said first and second end surfaces; said cover member comprising a generally flat insulation member having first and second metal latch members fixed to its oposite ends q member, said cover member covering said first surface fo said base after a multiconductor cable is connected to said tines of said contacts, said first and second latch members being engageable with said first and second raised latch receiving members respectively; said first and second metal latch members being capable of easy removal from said first and second raised latch receiving members and replacement without breakage; a metal strain relief member having a length at least equal to the length of said cover member; said metal strain relief member having bifurcated ends which are inwardly bent; said cover member having first and second slots at its said first and second end surfaces for receiving said inwardly bent bifurcated ends of said strain relief member; said strain relief member being capable of easy removal and replacement without breakage.

11. The connector of claim 10, wherein said first and second metal latch members are flexible rectangular frame members; said cover member having integral latch members having pyramidal shaped surfaces and indented bases extending from the respective ends of said cover member; said flexible rectangular frame member being captured in said indented bases.

12. The conenctor of claim 10, wherein adjacent tines of said contacts are spaced by 0.025 inch.

13. The connector of claim 10, wherein said plurality of contacts fixed in said insulation base are disposed in two parallel rows, with said insulation piercing tines of said contacts in one of said rows being oriented asymmetrically to said insulation piercing tines of said contacts of the other of said rows.

14. The connector of claim 10, wherein said tines of said contacts in said one row are oriented 180° with respect to said tines of said contacts in said other row.

15. A conductor for connection to the wires of a flat multiconductor cable; said connector comprising an insulation base, a cover member, and first and second metal latch members; said insulation base having a plurality of contacts fixed therein and disposed in at least one rwo; each of said contacts having insulation piercing tines extending above a first surface of said base, each of said contacts having a nose end connectable to respective header pins which extend into a second surface of said base; said base having first and second end surfaces, and first and second raised latch receiving members extending outwardly from said first and second end surfaces; said cover member comprising a generally flat insulation member having first and second metal latch members fixed to its opposite ends and extending perpendicularly from the length of said cover member, said cover member covering said first surface of said base after a multi-conductor cable is connected to said tines of said contacts, said first and second latch members being engageable with said first and second raised latch receiving members respectively; said first and second metal latch members being capable of easy removal from said first and second raised latch receiving members and replacement without breakage; said first and second metal latch members are flexible rectangular frame members; said cover member having integral latch members having pyramidal shaped surfaces and indented bases extending from the respective ends of said cover member; said flexible rectangular frame member being captured in said indented bases; a metal strain relief member having a length at least equal to the length of said cover member; said metal strain relief member having bifurcated ends which are inwardly bent; said cover member having first and second slots at its said first and second end surfaces for receiving said inwardly bent bifurcated ends of said strain relief member; said strain relief member being capable of easy removal and replacement without breakage.

16. The connector of claim 15, wherein adjacent tines of said contacts are spaced by 0.025 inch.

17. The connector of claim 15, wherein said tines of said contacts in said one row are oriented 180° with respect to said tines of said contacts in said other row.

18. The connector of claim 15, wherein said plurality of contacts fixed in said insulation base are disposed in two parallel rows, with said insulation piercing tines of said contacts in one of said rows being oriented assymmetrically to said insulation piercing tines of said contacts of the other of said rows.

19. The connector of claim 18, wherein said ones of said contacts in said one row are oriented 180° with respect to said tines of said contacts in said other row.

20. The connector of claim 19, wherein adjacent tines of said contacts are spaced by 0.025 inch.

* * * * *